US008118020B2

(12) United States Patent
Rummel et al.

(10) Patent No.: US 8,118,020 B2
(45) Date of Patent: Feb. 21, 2012

(54) GAS COOKTOP

(75) Inventors: Randy L. Rummel, Huntington Beach, CA (US); Dan Nichols, Huntington Beach, CA (US); Eric H. Y. Deng, Irvine, CA (US)

(73) Assignee: Dynamic Cooking Systems, Inc., Huntington Beach, CA (US)

( * ) Notice: Subject to any disclaimer, the term of this patent is extended or adjusted under 35 U.S.C. 154(b) by 1712 days.

(21) Appl. No.: 11/007,634

(22) Filed: Dec. 7, 2004

(65) Prior Publication Data

US 2005/0161037 A1 Jul. 28, 2005

Related U.S. Application Data

(60) Continuation of application No. 10/807,548, filed on Mar. 23, 2004, now abandoned, which is a continuation of application No. 09/960,041, filed on Sep. 20, 2001, now Pat. No. 6,712,065, application No. 11/007,634, which is a continuation-in-part of application No. 29/202,995, filed on Apr. 7, 2004, now abandoned, which is a continuation of application No. 29/160,538, filed on May 10, 2002, now Pat. No. Des. 489,933, which is a division of application No. 29/140,820, filed on Apr. 25, 2001, now Pat. No. Des. 461,090, application No. 11/007,634, which is a continuation-in-part of application No. 29/199,136, filed on Feb. 10, 2004, now abandoned, which is a continuation of application No. 29/178,552, filed on Mar. 26, 2003, now Pat. No. Des. 486,349, which is a division of application No. 29/154,220, filed on Jan. 17, 2002, now Pat. No. Des. 475,569.

(51) Int. Cl.
*F24C 15/10* (2006.01)

(52) U.S. Cl. ..... 126/211; 126/214 R; 431/191

(58) Field of Classification Search ..... 431/191; 126/211, 152 R, 217, 39 R, 39 E, 25 R, 152 B, 126/214 C, 214 R, 215, 216; D7/408, 407, D7/409, 346

See application file for complete search history.

(56) References Cited

U.S. PATENT DOCUMENTS

| | | | | | |
|---|---|---|---|---|---|
| 1,125,726 | A | * | 1/1915 | Ruppel | 126/214 R |
| 1,748,742 | A | | 2/1930 | Thompson et al. | |
| 1,931,517 | A | * | 10/1933 | Toelle | 126/39 N |
| D108,114 | S | | 1/1938 | Burrow | |
| 2,480,045 | A | | 8/1949 | Reeves | |
| 2,632,438 | A | * | 3/1953 | Chambers | 126/214 C |
| 2,654,359 | A | | 10/1953 | Reeves | |
| 2,766,683 | A | | 10/1956 | Kanz | |
| 2,823,657 | A | | 2/1958 | Broderick | |
| 2,862,667 | A | * | 12/1958 | Hillebrand | 236/32 |
| 2,973,524 | A | | 3/1961 | Daniels | |
| D201,938 | S | | 8/1965 | Tecton | |
| 3,404,673 | A | * | 10/1968 | Tappan et al. | 126/39 R |
| 3,923,037 | A | | 12/1975 | Donato | |
| D289,487 | S | | 4/1987 | Schultz | |
| D293,070 | S | | 12/1987 | Cerola | |
| 4,971,024 | A | | 11/1990 | Albon et al. | |

(Continued)

*Primary Examiner* — Kenneth Rinehart
*Assistant Examiner* — Chuka C Ndubizu
(74) *Attorney, Agent, or Firm* — Knobbe, Martens, Olson & Bear, LLP

(57) ABSTRACT

Five burners are arranged in the form of an "x." The units are covered by a grate including two side sections, each covering two burners, and a central section covering the center burner. The side sections have concave inner side edges that mate with a circular segment of the center grate.

6 Claims, 3 Drawing Sheets

U.S. PATENT DOCUMENTS

| | | | | | |
|---|---|---|---|---|---|
| 5,038,748 | A | | 8/1991 | Lockwood et al. | |
| 5,046,477 | A | | 9/1991 | Bennett et al. | |
| D326,029 | S | | 5/1992 | Lok | |
| D333,234 | S | | 2/1993 | Nichols | |
| D334,866 | S | | 4/1993 | Warren | |
| D342,641 | S | | 12/1993 | Falk | |
| 5,372,121 | A | | 12/1994 | Castillo et al. | |
| D372,630 | S | * | 8/1996 | Lewis et al. | D7/346 |
| D378,262 | S | | 3/1997 | Sparks | |
| D421,694 | S | | 3/2000 | Kitabayashi et al. | |
| 6,098,613 | A | * | 8/2000 | Wiersma | 126/273 R |
| D430,451 | S | | 9/2000 | Bordel | |
| 6,257,228 | B1 | | 7/2001 | Braccini | |
| D458,803 | S | | 6/2002 | Becker et al. | |
| D461,090 | S | | 8/2002 | Rummel et al. | |
| D467,461 | S | | 12/2002 | Jones et al. | |
| D473,096 | S | | 4/2003 | Resuello et al. | |
| D481,589 | S | | 11/2003 | Becker et al. | |
| D486,350 | S | | 2/2004 | Nichols | |
| D486,690 | S | | 2/2004 | Becker et al. | |
| 6,712,066 | B1 | | 3/2004 | Atkinson et al. | |

* cited by examiner

GAS COOKTOP

CROSS REFERENCE TO RELATED APPLICATION

The present application is a continuation of U.S. application Ser. No. 10/807,548, filed Mar. 23, 2004 now abandoned, which is a continuation of, and incorporated by reference the entirety of, U.S. application Ser. No. 09/960,041, filed Sep. 20, 2001 and issued on Mar. 30, 2004 as U.S. Pat. No. 6,712,065. The present application also is a continuation-in-part of U.S. Design application Ser. No. 29/202,995, filed on Apr. 7, 2004 now abandoned, which is a continuation of, and incorporated by reference the entirety of, U.S. Design application Ser. No. 29/160,538, filed on May 10, 2002 and issued on May 18, 2004 as U.S. Design Pat. No. 489,933, which is a divisional of, and incorporated by reference the entirety of, U.S. Design application Ser. No. 29/140,820, filed on Apr. 25, 2001 and issued on Aug. 6, 2002 as U.S. Design Pat. No. D461,090. This present application is also a continuation-in-part of U.S. Design application Ser. No. 29/199,136, which was filed on Feb. 10, 2004 now abandoned, which is a continuation of, and incorporated by reference the entirety of, U.S. Design application Ser. No. 29/178,552, which was filed on Mar. 26, 2003 and issued on Feb. 10, 2004 as U.S. Design Pat. No. D486,349, which was a divisional of, and incorporated by reference the entirety of, U.S. Design Pat. application Ser. No. 29/154,220, which was filed on Jan. 17, 2002 and issued on Jun. 10, 2003 as U.S. Design Pat. No. D475,569. Each of these prior applications is hereby incorporated by reference in the entirety.

BACKGROUND OF THE INVENTION

This invention relates to the construction of a gas cooktop or range in a particularly efficient and compact arrangement.

In smaller kitchens, space for a gas cooktop is limited. One common width for smaller residential ranges is 30 inches, with the cooktop having four burners arranged in the form of a rectangle.

In some busy cooking situations, it is desirable to have more than four burners. Further, in some situations, it is desirable to have a particularly large container positioned over a burner. With the compact four burner arrangement, a large container cannot be centrally positioned on any of the units without hanging over a side edge of the cooktop, and that space is typically not available for such positioning because of an adjacent counter, wall or other restriction. Further, even if space is available adjacent the sides of the cooktop, the back units could not be utilized because the container would engage the short back wall of the cooktop or the adjacent wall in the kitchen. If the front units were employed, the container might hang over the front edge of the cooktop and be in a somewhat precarious or dangerous position.

Cooktops are of course available having more than four burners, but the burners are not arranged sufficiently compact to fit a 30" width requirement.

Accordingly, the need exists for an improved gas cooktop or range construction to satisfy the foregoing objectives.

SUMMARY OF THE INVENTION

Briefly stated, a gas cooktop or range is provided having five burners arranged in a very compact manner. Four burners are positioned in a rectangular pattern with a fifth burner centrally positioned between the four. More specifically, the fifth burner is positioned halfway between the two front to back rows and halfway between the two side to side rows. With such an arrangement, a cooktop can be provided with no more than a 30 inch width and an even smaller front to back dimension of about 24 inches. Of course, the five burner configuration is also practical and space efficient in situations in which each individual burner is to be made larger, or spaced further from adjacent units.

With gas burners, it is of course necessary to have a grate above the burners. In a preferred gas cooktop arrangement, the grate is formed in three sections. This includes two spaced side sections extending from front to back with each side section extending over a front burner and a back burner. A central grate section extends from front to back and mates with the adjacent side sections. The side sections have a generally rectangular shape, except that the edge facing the central section has a concave central portion curved to fit with circular central section that extends over the central burner. The circular section is integral with relatively narrow front and back portions that extend respectively to be aligned with the front and back edges of the adjacent side sections.

DETAILED DESCRIPTION OF THE PREFERRED EMBODIMENT

Figure 1:
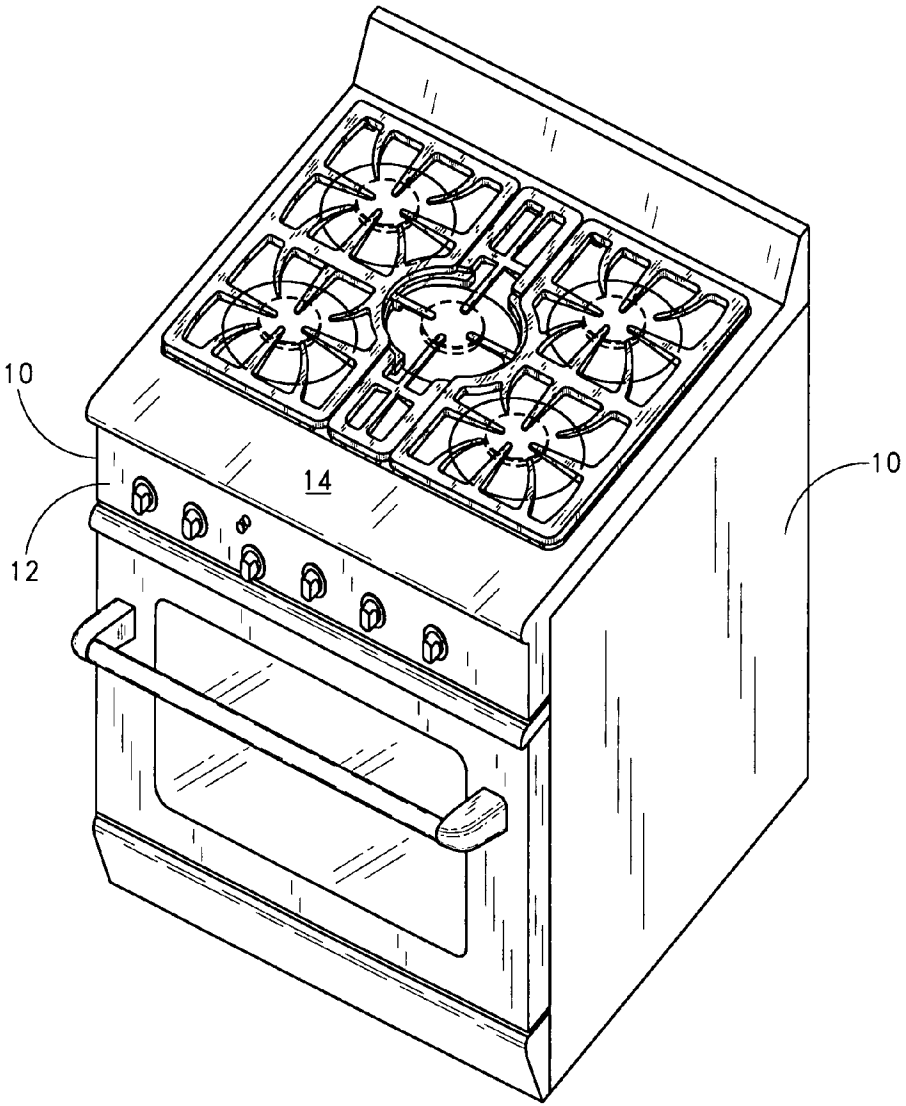
FIG. 1 is a perspective view of a range with a five burner cooktop.
Figure 2:
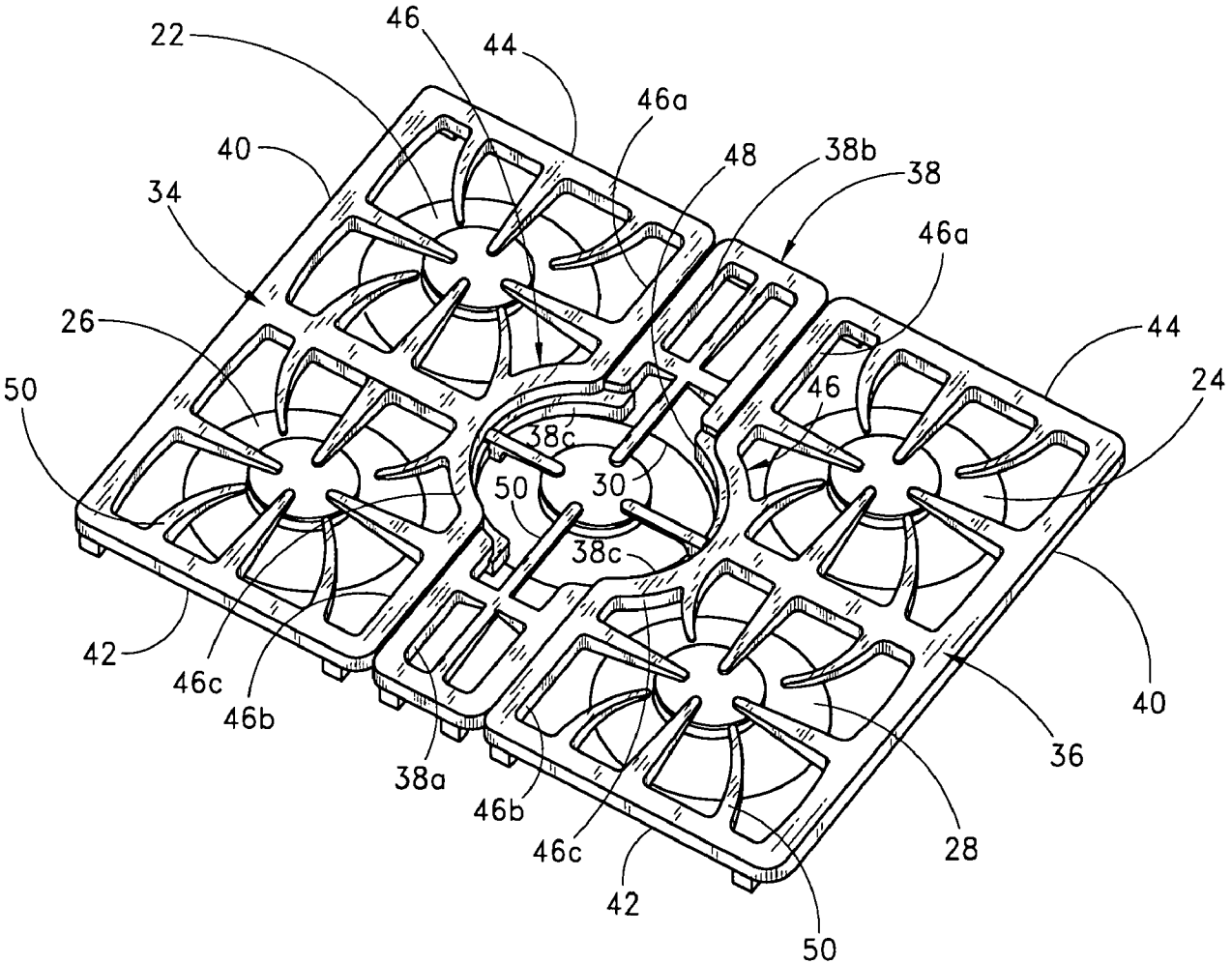
FIG. 2 is a perspective view of the cooktop of FIG. 1.
Figure 3:
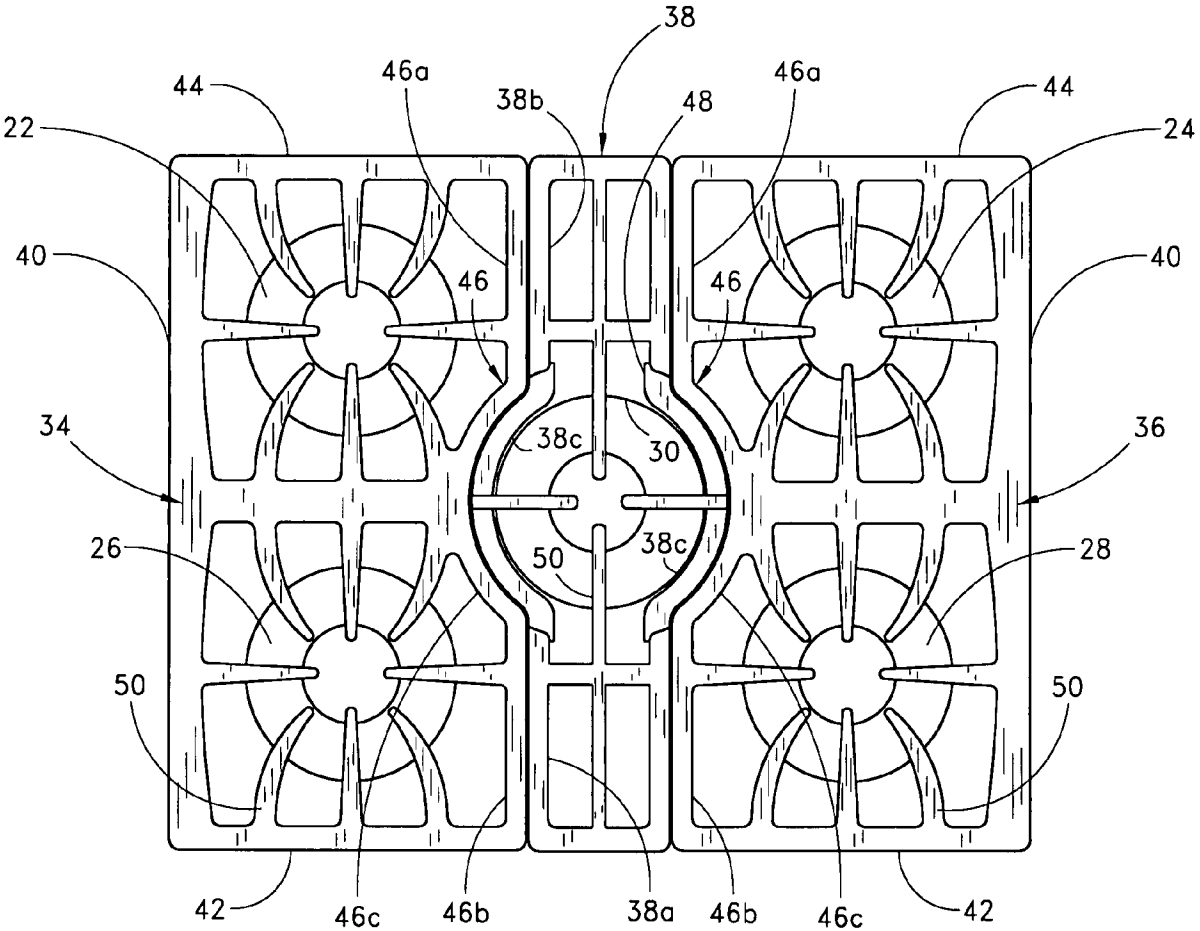
FIG. 3 is a plan view of the cooktop of FIG. 2.

Referring to the drawings, illustrated in FIG. 1 is a gas range 10 including an oven 12 and a cooktop 14. As can be seen, particularly from FIGS. 2 and 3, the cooktop has five circular burners. This includes four burners 22, 24, 26, and 28 arranged in a generally rectangular configuration with burners 22 and 24 forming a back row and burners 26 and 28 forming a front row. Stated differently, burners 22 and 24 form a left side, back-to-front row, and burners 24 and 28 form a right side, back-to-front row. While the cooktop is shown on a gas range, it can of course be simply a counter mounted cooktop.

In accordance with the invention, these four burners are preferably positioned so that a fifth burner 30 is centrally positioned between the other four. As can be seen, the fifth unit is centrally positioned between the two side rows and centrally positioned between the front and back rows. Stated differently yet, the burner 30 is centrally positioned between the front and back edges of the cooktop and spaced centrally between the left and right side edges of the cooktop. As another relationship, it can be stated that the center of the burner 30 is preferably at the intersection of a diagonal line between the centers of burners 22 and 28 and a diagonal line between the centers of burners 24 and 26, thus forming an "x."

With gas burners, a grate extends over the burners. In the arrangement illustrated, the grate includes a left grate section 34, a right grate section 36 and a central grate section 38. As may be seen, the left and right sections have generally a rectangular shape with an outer side wall 40, a front end wall 42, a rear end wall 44, and an inner side wall 46. Each side section extends over a front and rear burner. The outer side wall and the end walls of each side section are straight; however, the inner wall, which faces the fifth burner 30, has straight front and back portions 46*a* and 46*b* with a concave recess 46*c* between the straight portions. These recessed portions form circular segments surrounding a portion of the center burner 30. More specifically, each recessed portion 46*c* extends about 135° of a circle.

Between the side grate sections, the center section 38 has a generally circular portion 38*c* positioned above the central burner 30 and centered between the front and back edges of the cooktop. The side circular segments of the central grate form convex segments that conform to or mate with the recessed portions of the adjacent edges of the side grate sections. In addition, the central section has a front segment 38*a* extending to the front edge of the side sections and a rear segment 38*b* extending to the rear of the side sections. The width of the front and rear segments is about half the outer diameter of the central portion 48 of the central grate section 38. Each of the grate sections includes a plurality of inwardly extending spaced fingers 50 for supporting a cooking utensil over a respective burner. Having the grate sections configured as illustrated is practical from the standpoint that they are easy to handle, allowing individual sections to be separately removed and replaced. Likewise, the size is such that they are convenient from a manufacturing and handling standpoint. In addition, the arrangement is aesthetically pleasing.

The grill sections are all in substantially the same plane. Thus, when an extra large container is placed over the center burner 30, the container can extend over the area above the surrounding burners, maximizing the size of container to be used.

From the foregoing, it can be seen that the compact arrangement illustrated provides the fifth burner in a 30 inch width cooktop that conventionally only accommodated four burners. The side units have been spread slightly from that typically employed with four burners in a 30 inch wide cooktop. The fifth burner 30 enables a large cooking utensil, such as a wok, to be centrally positioned on the central grate portion 48 without having to be concerned about a portion of the container extending over an edge of the cooktop.

The present invention may, of course, be carried out in other specific ways than those herein set forth without departing from the spirit and the central characteristics of the invention. For example, the particular dimensions used in describing the invention are not intended to limit the scope of the claims, but are provided only as examples. The present embodiments are therefore to be considered in all respects as illustrative and not restrictive and all changes, within the meaning and equivalency range of the appended claims, are intended to be embraced therein.

What is claimed is:

1. A gas cooktop comprising:

four cooking burners arranged in a substantially rectangular shape;

a fifth cooking burner substantially centrally positioned between said four cooking burners, with said fifth cooking burner being substantially equal distant from each of said four cooking burners; and a first grate extending over two of said four cooking burners and a second grate extending over another two of said four cooking burners, said first grate comprising a recessed portion and said second grate comprising a second recessed portion, said fifth cooking burner being positioned within a region defined between said first and second recessed portions, wherein a height of said four cooking burners above a top surface of said cooktop and a height of said fifth cooking burner above said top surface are substantially the same.

2. The cooktop of claim 1, wherein a height of said first grate above said top surface and a height of said second grate above said top surface are substantially the same.

3. A gas cooktop comprising:

four cooking burners arranged in a substantially rectangular shape;

a fifth cooking burner substantially centrally positioned between said four cooking burners, with said fifth cooking burner being substantially equal distant from each of said four cooking burners; and a first grate extending over two of said four cooking burners and a second grate extending over another two of said four cooking burners, said first grate comprising a recessed portion and said second grate comprising a second recessed portion, said fifth cooking burner being positioned within a region defined between said first and second recessed portions, and a third grate being positioned between said first grate and said second grate, said third grate comprising a portion that generally circumscribes said fifth cooking burner.

4. A gas appliance comprising:

a rectangular cooktop about 30 inches wide and about 24 inches deep, said cooktop comprising four cooking burners arranged in substantially a rectangular shape, said four cooking burners having a generally consistent height above a top surface of said cooktop;

said cooktop further comprising a fifth cooking burner centrally positioned between said four cooking burners, with said fifth cooking burner being substantially equal distant from each of the four cooking burners and said fifth cooking burner having height above said top surface substantially the same as said four cooking burners; and a first grate extending over two of said four cooking burners, a second grate extending over another two of said four cooking burners, said fifth cooking burner being positioned between said first grate and said second grate, said first and second grate each defining a portion of a circle that circumscribes said fifth cooking burner, a third grate being interposed between at least a portion of said first grate and said second grate, said third grate comprising at least one finger that extends over at least a portion of said fifth cooking burner.

5. A gas cooktop comprising:

a top surface having a length and a width, four cooking burners arranged along said top surface in a substantially rectangular shape such that a first and second side row of cooking burners and a front and back row of cooking burners is defined by said four cooking burners;

a fifth cooking burner being interposed between said first and second side rows of cooking burners and said fifth cooking burner also is interposed between said front and back rows of cooking burners; and a left grate section extending over said first side row of cooking burners and a right grate section extending over said second side row of cooking burners, said left grate section and said right grate section each comprising a laterally inset portion proximate said fifth cooking burner, a center grate section being interposed between said left grate section and said right grate section.

6. A gas cooktop comprising:

a top surface having a length and a width, four cooking burners arranged along said top surface in a substantially rectangular shape such that a first and second side row of cooking burners and a front and back row of cooking burners is defined by said four cooking burners;

a fifth cooking burner being interposed between said first and second side rows of cooking burners and said fifth cooking burner also is interposed between said front and back rows of cooking burners; and a left grate section extending over said first side row of cooking burners and a right grate section extending over said second side row of cooking burners, said left grate section and said right grate section each comprising a laterally inset portion proximate said fifth cooking burner, each of said left and right grate sections has a generally rectangular shape with an outer side wall, a front end wall, a rear end wall, and an inner side wall, said laterally inset portion being defined in said inner side wall as a concave recess, said inner side wall of each of said left and right grate sections further comprises a straight back portion and a straight front portion with said concave recess being disposed between said sections, wherein each of said concave recesses defines an arc of approximately 135 degrees.

* * * * *